US006468056B1

(12) United States Patent
Murakoshi

(10) Patent No.: US 6,468,056 B1
(45) Date of Patent: Oct. 22, 2002

(54) DIAPHRAGM BREAKAGE PROTECTION IN A RECIPROCATING DIAPHRAGM PUMP

(75) Inventor: Fusao Murakoshi, Tokyo (JP)

(73) Assignee: Nikkiso Co., Ltd., Tokyo (JP)

( * ) Notice: Subject to any disclaimer, the term of this patent is extended or adjusted under 35 U.S.C. 154(b) by 0 days.

(21) Appl. No.: 09/709,944

(22) Filed: Nov. 10, 2000

(30) Foreign Application Priority Data

Nov. 12, 1999 (JP) ..... 11-322213

(51) Int. Cl.[7] ..... F04B 43/06; F04B 45/00
(52) U.S. Cl. ..... 417/395; 417/63
(58) Field of Search ..... 417/63, 383, 387, 417/388, 386, 395

(56) References Cited

U.S. PATENT DOCUMENTS

| | | | | |
|---|---|---|---|---|
| 3,972,654 A | * | 8/1976 | Clayton et al. | 417/388 |
| 4,019,837 A | * | 4/1977 | Eull | 417/386 |
| 4,068,982 A | * | 1/1978 | Quarve | 417/387 |
| 4,430,048 A | * | 2/1984 | Fritch | 417/383 |
| 4,621,989 A | * | 11/1986 | Burgert | 417/383 |
| 5,074,757 A | * | 12/1991 | Hora | 417/63 |

FOREIGN PATENT DOCUMENTS

| | | | | |
|---|---|---|---|---|
| JP | 406017757 | * | 1/1994 | F04B/43/06 |
| JP | 406081770 | * | 3/1994 | F04B/43/06 |
| JP | 406307341 | * | 11/1994 | F04B/43/06 |
| JP | 407259741 | * | 10/1995 | F04B/43/02 |

* cited by examiner

*Primary Examiner*—Teresa Walberg
*Assistant Examiner*—Leonid M Fastovsky
(74) *Attorney, Agent, or Firm*—Darby & Darby

(57) ABSTRACT

A diaphragm pump prevents deformation, breakage, and the like of a diaphragm caused by the diaphragm being pushed strongly against a discharge opening during operation of the diaphragm pump, and that also provides smooth fluid transfer of the pumped fluid. At its extreme discharge position, the diaphragm is blocked from entering the pumped fluid discharge opening by a perforated diaphragm protecting device covering the fluid discharge opening. Selection of the size of openings in the diaphragm protecting device, appropriate for the materials being pumped, allows smooth movement of pumped fluid in the pump through the pumped fluid discharge opening, without interference. In one embodiment, the diaphragm protecting device is a movable perforated plate which is resiliently urged open, and which is pushed closed when the diaphragm reaches its discharge extreme position.

5 Claims, 2 Drawing Sheets

DIAPHRAGM BREAKAGE PROTECTION IN A RECIPROCATING DIAPHRAGM PUMP

BACKGROUND OF THE INVENTION

The present invention relates to a reciprocating diaphragm pump. More specifically, the present invention relates to a reciprocating diaphragm pump that provides diaphragm breakage prevention and improved intake into a pump chamber.

In reciprocating diaphragm pumps, a diaphragm divides the space inside the pump into a pumped fluid side space and a working oil side space. A piston capable of reciprocating motion is disposed on the working fluid side space. The reciprocating motion of this piston causes, via the working fluid, the diaphragm to move in a reciprocating manner. This causes the pumped fluid to be sucked in to the pumped fluid side space and to be discharged out from the pump, thus providing continuous transfer of the pumped fluid.

When the piston moves backward, the pressure of the working fluid drops, thereby causing the diaphragm to be pulled toward the working oil, making it expand toward the working fluid side. When this happens, an intake valve disposed in an intake flow path that communicates with the pumped fluid side space is opened, and the pumped fluid flows into the pumped fluid side space. Next, when the piston moves forward, the pressure of the working oil increases, causing a force in the direction of the pumped fluid side to be received by the diaphragm, which then deforms in the direction of the pumped fluid side while pushing the pumped fluid. Since the intake valve is closed at the time, the pumped fluid in the pump does not backflow toward the intake flow path and is instead sent out from the pump through a discharge flow path disposed in the pumped fluid side space. By repeating these steps, the pumped fluid is transferred continuously.

In the steps described above, the application of excessive force by the working oil on the diaphragm can cause deformation or damage to the diaphragm. To prevent this, a counter plate (a plate having many thin holes) is generally installed in the space inside the pump to prevent excessive deformation of the diaphragm. Among reciprocating diaphragm pumps, there are those that have counter plates in both the pumped fluid side space and the working oil side space and those that have a counter plate only in the working fluid side space.

With pumps that have counter plates in both the pumped fluid side space and the working oil side space, excessive deformation of the diaphragm in both the intake step and the discharge step is prevented. However, since the intake opening is covered by a counter plate, the pumped fluid encounters resistance from the counter plate when it is being sucked into the pump. For this reason, the pump cannot be operated unless intake conditions are especially good, and is not suited for high-speed operations, high-viscosity fluids, or transfer of slurries.

With pumps that have a counter plate in just the working oil side space, there is no counter plate covering the intake opening so the problem described above is eliminated. If there is too much working oil in the working oil side space when the pump is started, however, the diaphragm may be excessively deformed. In particular, a section of the diaphragm that abuts the discharge opening can be pushed into the discharge opening, leading to deformation or breakage of this section.

OBJECTS AND SUMMARY OF THE INVENTION

It is an object of the present invention to overcome the defects described above of reciprocating diaphragm pumps that do not have counter plates in the pumped fluid side space.

Another object of the present invention is to provide a reciprocating diaphragm pump that can prevent deformation, breakage, and the like of the diaphragm caused by the diaphragm being pushed strongly against the discharge opening during operation of the reciprocating diaphragm pump and that can also ensure smooth fluid transfer of the pumped fluid.

In order to achieve these objects, the present invention provides a reciprocating diaphragm pump including: a pump chamber divided by a diaphragm into an active oil chamber and a pumped fluid chamber, the pumped fluid chamber not having a counter plate; a pumped fluid intake opening section transferring pumped fluid to the pumped fluid chamber; and a pumped fluid discharge opening section discharging the pumped fluid from the pumped fluid chamber.

The pumped fluid discharge opening section includes means for preventing diaphragm breakage by preventing the diaphragm from entering the pumped fluid discharge opening when the pumped fluid in the pumped fluid chamber is discharged from the pumped fluid chamber.

Diaphragm breakage preventing means can be a disc-shaped body formed with a plurality of small openings mounted in a ring-shaped cavity disposed at the pumped fluid discharge opening.

Diaphragm breakage preventing means can be an opening/closing plate that is normally open and that can open and close the pumped fluid discharge opening using a biasing member.

The above, and other objects, features and advantages of the present invention will become apparent from the following description read in conjunction with the accompanying drawings, in which like reference numerals designate the same elements.

BRIEF DESCRIPTION OF THE DRAWINGS

FIGS. 2 (*b*) and 2 (*c*) are plan drawings to which reference will be made in describing other examples of diaphragm breakage preventing means mounted in a reciprocating diaphragm pump.

FIG. 3 (*b*) is a vertical cross-section drawing to which reference will be made in describing the diaphragm breakage preventing means mounted in a reciprocating diaphragm pump when a protective plate is held in a ring-shaped cavity.

DETAILED DESCRIPTION OF THE PREFERRED EMBODIMENTS

In the reciprocating diaphragm pump of the present invention, a counter plate is not installed in a pumped fluid chamber and means for preventing diaphragm breakage is disposed at a pumped fluid discharge opening in the pumped fluid chamber.

Diaphragm breakage preventing means prevents the diaphragm from entering the pumped fluid discharge opening when the pumped fluid in the pumped fluid chamber is discharged from the pumped fluid chamber. Also, it allows the pumped fluid in the pumped fluid chamber to be sent smoothly to the pumped fluid discharge opening. As long as these features are present, there are no special restrictions regarding the structure, materials, or the like used in this diaphragm breakage preventing means. The shape of this diaphragm breakage preventing means can, for example, be in the form of a cover or stopper mounted on the pumped fluid discharge opening, or it can be a sheet-shaped structure covering the pumped fluid discharge opening.

Besides this diaphragm breakage preventing means, the other structures in the reciprocating diaphragm pump according to the present invention have no special restrictions regarding structure and can be designed as appropriate for the objective. A structure similar to a conventional reciprocating diaphragm pump is acceptable.

Figure 1:
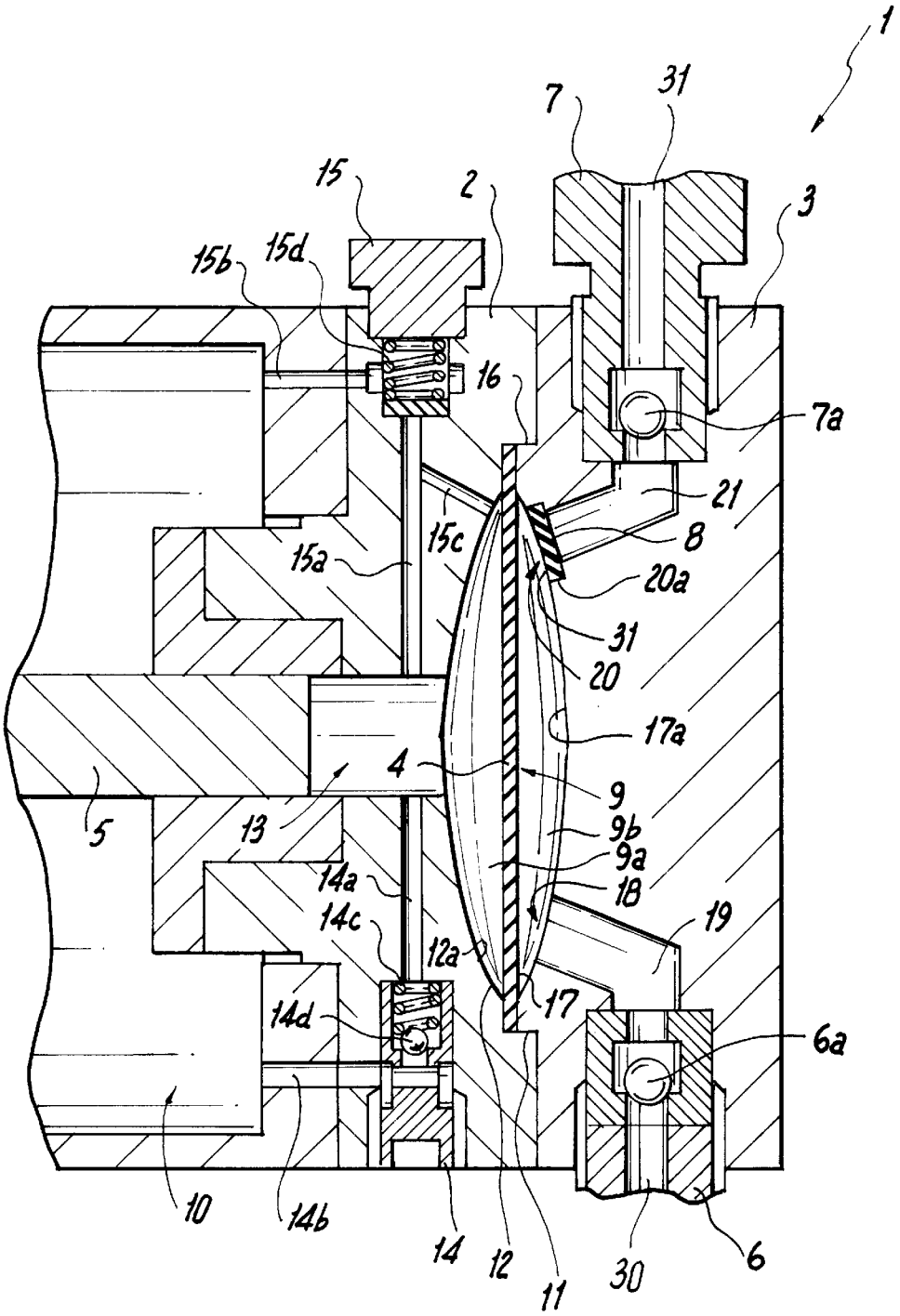
FIG. 1 is a cross-section drawing to which reference will be made in describing a pump of a reciprocating diaphragm pump.

Referring to FIG. 1, a main pump unit in a reciprocating diaphragm pump 1 serves the central role in the reciprocating diaphragm pump 1 to draw in and discharge the pumped fluid. Thus, the description of the reciprocating diaphragm pump 1 will focus on the main pump unit. The elements of the reciprocating diaphragm pump 1 other than main pump unit can be similar to those of conventional reciprocating diaphragm pumps.

The main pump unit includes a back-up plate 2, a diaphragm head 3, a diaphragm 4, a piston 5, a suction valve 6, a discharge valve 7, and diaphragm breakage preventing means 8.

The back-up plate 2 and the diaphragm head 3 are coupled with the diaphragm 4 interposed therebetween. This forms a pump chamber 9. The pump chamber 9 is divided by the diaphragm 4 into an working oil chamber 9*a* and a pumped fluid chamber 9*b*.

The back-up plate 2 is a cylindrical member inside which is formed an oil bath 10 in which the working oil is stored. A cavity 11 is formed at one end surface of the back-up plate 2, and a cavity 12 is formed at the bottom of the cavity 11. The cavity 12 is formed with an arcuate cross-section. Along with the diaphragm 4, cavity 12 forms the working oil chamber 9*a*.

A piston chamber 13 is disposed in the back-up plate 2. Piston 5, disposed in the piston chamber 13, slides back and forth in a reciprocating manner in the piston chamber 13. The piston 5 moves within the piston chamber 13 toward and away from the piston chamber 9. In the following description, piston 5 is described as "moving forward" when it moves in the direction of the pump chamber 9, and is described as "moving backward" when it moves in the opposite direction.

An oil supply valve 14 is disposed at the bottom end of the outer perimeter surface of the back-up plate 2. A relief valve 15 is disposed at the upper end of the outer perimeter surface. Oil supply valve 14 and relief valve 15 are connected to the oil bath 10 through an oil supply intake 14*b* and a discharge oil discharge 15*b*, respectively. Furthermore, a discharge oil intake 15*a* and the working oil chamber 9*a* are connected by a vent path 15*c*.

The working oil fills the spaces formed by the working oil chamber 9*a*, the piston chamber 13, the oil supply discharge 14*a*, the discharge oil intake 15*a*, and the vent path 15*c*.

The oil supply valve 14 is a ball check valve operated with a spring. When the pump operates normally, oil supply valve 14 is kept closed by fluid pressure in the piston chamber, the action of a spring 14*c*, and the weight of a valve 14*d*. The relief valve 15 is also kept closed by the action of the spring 15*d*. Thus, the piston chamber 13 and the flow paths leading to the piston chamber 13 are usually kept sealed.

If the pressure in the piston chamber 13 drops below a fixed minimum level due to leakage of working oil from the piston chamber 13 or the like, the valve 14*d* is unable to resist the pressure of the working oil in the oil bath 10 and rises. This causes the working oil to flow into the piston chamber 13 from the oil bath 10 via the oil supply valve 14 and the oil supply discharge 14*a*. Then, when the pressure in the concave space 17 is equalized with the pressure of the working oil in the oil bath 10, the valve 14*d* descends and the oil supply valve 14 is closed.

If the pressure in the piston chamber 13 rises to or above a fixed maximum level, the relief valve 15 opens. Working oil flows from the piston chamber 13 to the oil bath 10 through the discharge oil intake 15*a*, the vent path 15*c*, the relief valve 15. The discharge oil flows through the discharge oil discharge 15*b* until the pressure in the piston chamber 13 decreases the fixed maximum level. In other words, the pressure in the piston chamber 13 is kept between upper and lower threshold levels by the actions of the oil supply valve 14 and the relief valve 15.

The diaphragm head 3 is a cylindrical member having the same outer diameter as the back-up plate 2. One end surface of the diaphragm head 3 includes a projection 16 that fits against the cavity 11. The upper surface of the projection 16 forms a cavity 17. The cavity 17, along with the diaphragm 4, forms the pumped fluid chamber 9*b*.

An intake opening 30 where the pumped fluid flows into the pumped fluid chamber 9*b* is disposed near the lower end of a cavity surface 17*a* that forms the cavity 17 on the diaphragm head 3. The section of the diaphragm head 3 that forms the intake opening 30 is the intake opening 18. An intake flow path 19 is formed from the intake opening 30 to the diaphragm head 3. The intake flow path 19 is connected to the intake valve 6 disposed at the lower end of the diaphragm head 3.

A discharge opening 31, through which pumped fluid from the pumped fluid chamber 9*b* is pumped, is disposed at a section of the cavity surface 17*a* near the upper end. The section of the diaphragm head 3 that forms the discharge opening 31 is a discharge opening section 20. A ring-shaped cavity 20*a* is disposed on the discharge opening section 20. A discharge flow path 21 having a circular cross-section shape with a small diameter is formed from the discharge opening section 20 into the diaphragm head 3 from the bottom surface of the ring-shaped cavity 20*a*. The discharge flow path 21 is connected to the discharge valve 7 disposed at the upper end of the diaphragm head 3. The intake valve 6 and the discharge valve 7 are check, or one-way, valves.

The intake flow path 19 and the discharge flow path 21 form a "pumped fluid flow path disposed in the pump chamber 9". The intake opening section 18 described above is the "pumped fluid intake opening section" of the present invention, and the discharge opening section 20 is the "pumped fluid discharge opening section" of the present invention.

The diaphragm 4 is a thin, circular membrane. The perimeter of the membrane is interposed between the bottom surface of the cavity 11 of the back-up plate 2 and the upper surface of the projection 16 of the diaphragm head 3. The diaphragm 4 is installed in the pump section 2 where it separates the pump chamber 9 into the working oil chamber 9*a* and the pumped fluid chamber 9*b*.

The diaphragm 4 is a flexible membrane that is fluidly balanced between the working oil in the piston chamber 13 and the pumped fluid in the pumped fluid chamber 9*b*. The diaphragm 4 is deformed alternately toward the working oil side and the pumped fluid side as the piston 5 moves forward and back. When the piston 5 is retracted, the pressure of the working oil in the piston chamber 13 drops, causing the diaphragm 4 to deform toward the working oil side. This sucks pumped fluid into the pumped fluid chamber 9*b*. When the piston 5 moves forward, the pressure of the working oil in the piston chamber 13 goes up, causing the diaphragm 4 to deform toward the pumped fluid. This pushes the pumped fluid in the pumped fluid chamber 9*b* out from the pumped fluid chamber 9*b*. The diaphragm 4 is formed so that it can be deformed toward the pumped fluid side all the way to a position where it tightly contacts the cavity surface 17*a*. Thus, all the pumped fluid in the pumped fluid chamber 9*b* is pushed out of the pumped fluid chamber 9*b*. The diaphragm 4 is generally formed from a PTFE or synthetic rubber.

Figure 2A:
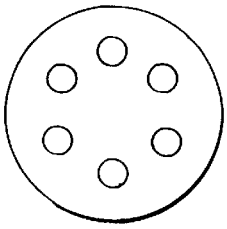
FIG. 2 (*a*) is a plan drawing to which reference will be made in describing diaphragm breakage preventing means mounted in a reciprocating diaphragm pump.
Figure 2B:
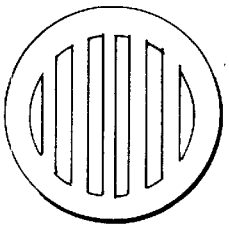
Figure 2C:
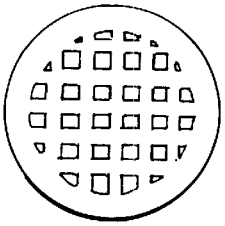

Diaphragm breakage preventing means 8 is mounted in the ring-shaped cavity 20*a* disposed on the discharge opening section 20. Referring to FIG. 2 (*a*), diaphragm breakage preventing means 8 is a disc-shaped body with a large number of openings, i.e., a plurality of small openings. Diaphragm breakage preventing means 8 is sized to fit into the ring-shaped cavity 20*a*. The size of diaphragm breakage preventing means 8 is such that it leaves essentially no gap between diaphragm breakage preventing means 8 and the outer perimeter surface of the ring-shaped cavity 20 when diaphragm breakage preventing means 8 is urged into the ring-shaped cavity 20. Also, the surface of diaphragm breakage preventing means 8 facing the pumped fluid chamber 9*a* is essentially never concave or convex relative to the concave surface 17*a*.

As described above, the diaphragm 4 can be deformed toward the pumped fluid side until it tightly contacts the cavity surface 17*a*. Thus, when a predetermined amount of working oil enters the working oil chamber 9*a*, the diaphragm 4 is pushed against the openings in the diaphragm breakage preventing means 8. If the diameters of these openings exceeds a fixed minimum value, the diaphragm 4 will be deformed in a convex manner inside the openings due to the pressure accompanying the operation of the reciprocating diaphragm pump 1. However, if the diameters of the openings are at or below the fixed value, the diaphragm 4 is essentially not be pushed into these openings even when it is pushed against these openings, thus preventing deformation. The diameter of the openings that can prevent deformation is determined by the material, the thickness, and other properties of the diaphragm 4, and of the fluid being pumped.

If the diameter of the openings is at or below a minimum value, the pumped fluid cannot smoothly pass through these openings disposed on diaphragm breakage preventing means 8 when the pumped fluid in the pumped fluid chamber 9*b* is discharged toward the discharge flow path 21. Thus, transfer of a fluid volume appropriate for the reciprocating diaphragm pump 1 is prevented. Thus, to provide fluid transfer appropriate for the reciprocating diaphragm pump 1, the diameter of the openings must be set up to be at or above a fixed minimum value. The diameter that allows the smooth passage of pumped fluid is determined from the properties of the pumped fluid.

Thus, the size of the diameter of the openings disposed on diaphragm breakage preventing means 8 is set so that the deformation of diaphragm breakage preventing means 8 described above is prevented while still allowing smooth passage of pumped fluid through the openings. This size is determined by the material of diaphragm breakage preventing means 8 and the properties of the pumped fluid and is generally in the range of 1–10 mm.

The number of openings disposed on diaphragm breakage preventing means 8 can be set to an appropriate number that allows smooth passage of the pumped fluid through the openings. The number is generally in the range of 1–100.

The structure of diaphragm breakage preventing means 8 is not restricted to a plurality of holes arranged concentrically as shown in FIG. 2 (*a*). Other structures can be used as long as the size and shape of the openings does not allow the diaphragm 4 to get pushed into the openings disposed on diaphragm breakage preventing means 8 so that the pumped fluid in the pumped fluid chamber 9*b* can move smoothly into the discharge flow path 21. A ribbed structure with interstitial openings, as shown in FIG. 2 (*b*) or openings arranged in a grid or lattice arrangement as shown in FIG. 2 (*c*) can be used. Alternatively, structures where fibrous members are woven in a mesh or the like can be used.

There are no special restrictions on the material used in diaphragm breakage preventing means 8 as long as its mechanical strength is adequate for the operation of the reciprocating diaphragm pump 1. For example, metallic or synthetic resin materials can be used.

There are no special restrictions on the method used to attach diaphragm breakage preventing means 8 to the ring-shaped cavity 20 as long as diaphragm breakage preventing means 8 does not separate from the ring-shaped cavity 22 during operation of the reciprocating diaphragm pump 1. For example, a diaphragm breakage preventing means support hook can be disposed on the edge of the discharge opening section 20, with the diaphragm breakage preventing means 8 engaged on this hook. Alternatively, external threads can be formed on the side surface of diaphragm breakage preventing means 8 and corresponding internal threads can be formed on the side surface of the ring-shaped cavity 20*a*, thus allowing diaphragm breakage preventing means 8 to be screwed into the ring-shaped cavity 20*a*. In another method, multiple threaded openings (not shown) can be formed on the diaphragm head 3 where it abuts the end surface of diaphragm breakage preventing means 8, and matching openings can be formed on diaphragm breakage preventing means 8, allowing diaphragm breakage preventing means 8 to be fixed in the ring-shaped cavity 20*a* using screws. In another method, diaphragm breakage preventing means 8 can be welded to the ring-shaped cavity 20*a*. In another method, openings can be formed directly on the diaphragm head 3.

As described above, the pumped fluid chamber 9*b* is formed with both an intake opening 30 and a discharge opening 31. Of these, diaphragm breakage preventing means 8 is disposed on the discharge opening section 20, which forms the discharge opening 31, but is not disposed on the intake opening section 18, which forms intake opening 30. Thus, there is no obstacle to pumped fluid being sucked into the pump chamber 9 at the intake opening section 18. This allows smooth suction of the pumped fluid into the pump chamber 9. Deformation of the diaphragm 4 due to its being pushed into the intake opening 30 does not need to be considered for the reasons described later.

With this kind of structure, the reciprocating diaphragm pump 1 is able to prevent deformation, breakage, and the like of the diaphragm 4 resulting from the diaphragm 4 being pushed strongly against the discharge opening section 20. At the same time, smooth suction and discharge of the pumped fluid is assured.

The following is a description of the operations of the reciprocating diaphragm pump 1.

A predetermined amount of working oil is placed in the space concave 17 so that no air remains in the concave space 17. A flow path connected to a container holding the pumped fluid is connected to the intake valve 6. The motor of the reciprocating diaphragm pump 1 is started, and the piston 5 is reciprocated.

First, as the piston 5 moves back, the volume of the space 17 increases so that the pressure of the working oil in the space 17 drops. When this happens, the diaphragm 4 is pulled toward the working oil side and tightly contacts the concave surface 12*a*.

As the diaphragm 4 is deformed toward the working oil side, the pumped fluid chamber 9*b* is in a state of negative pressure. Since the discharge valve 7 is sealed, the pumped fluid is sucked up from the intake valve 6. The pumped fluid pushes up the valve 6*a* of the intake valve 6, and passes through the intake flow path 19 and flows into the pumped fluid chamber 9*b*. Since no counter plate or the like is installed at the intake opening 18, the pumped fluid can flow in smoothly. When the pressure in the pumped fluid chamber 9*b* is restored to standard pressure, the flow of the pumped fluid into the pumped fluid chamber 9*b* stops, the valve 6*a* returns to its lowest position, and the intake flow path of the pumped fluid is sealed.

After reaching the rearward endpoint, the piston 5 starts moving forward. As this happens, the pressure of the working oil in the space 17 rises. This causes the diaphragm 4 to be pushed toward the pumped fluid side. Since, as described above, the intake valve 6 is sealed at this point, the pumped fluid in the pumped fluid chamber 9*b* cannot move toward the intake flow path 19. Also, since, as described above, the openings formed on diaphragm breakage preventing means 8 are large enough to allow the pumped fluid to pass smoothly, the pumped fluid passes through the openings, flows into the discharge flow path 21, pushes up the valve 7*a* of the discharge valve 7, and is discharged out from the pump.

As the piston 5 moves further forward, the diaphragm 4 deforms toward the pumped fluid side into tight contact with the cavity surface 17*a*. Then, if the amount of working oil in the space 17 is at or above a predetermined value, the diaphragm 4 is pushed against the cavity 17 after coming into tight contact with the cavity surface 17*a*. At this time, the intake valve 6 is closed, as described above. The resistance from the pumped fluid filling the intake flow path 19 prevents the diaphragm 4 from being pushed into the intake opening 30. Thus, even if diaphragm breakage preventing means is disposed at the intake opening section 18, the diaphragm 4 is not deformed in a way that permits it to enter the intake opening 30.

Since flow is possible from the pumped fluid chamber 9*b* to the discharge flow path 21, the diaphragm 4 is pressed against the discharge opening section 20. If no diaphragm breakage preventing means 8 is present at the discharge opening section 20, the diaphragm 4 would be pushed into the discharge opening section 20, leading to deformation, breakage, or the like. However, in the reciprocating diaphragm pump 1 of the present invention, diaphragm breakage preventing means 8 is disposed at the discharge opening section 20. The diameters of the openings formed on diaphragm breakage preventing means 8 are small enough to prevent the diaphragm 4 from being pushed into these openings. Thus, with reciprocating diaphragm pump 1 equipped with diaphragm breakage preventing means 8, there will be no deformation, breakage, or the like even if the diaphragm 4 is pushed against the discharge opening section 20 during operation of the pump.

In other words, diaphragm breakage preventing means 8 assures smooth motion of the pumped fluid while preventing deformation, breakage, and the like caused by the diaphragm 4 pressing into the discharge opening section 20.

When the movement of the pumped fluid from the pumped fluid chamber 9*b* to the discharge flow path 21 stops, the valve 7*a* returns to its lowermost position, sealing the discharge flow path 21. Then, after reaching its forward motion endpoint, the piston 5 moves back. This releases the intake valve 6 and the pumped fluid flows into the pumped fluid chamber 9*b*.

The reciprocating diaphragm pump 1 repeats the steps described above and allows fluid transfer to take place while preventing deformation, breakage, and the like of the diaphragm.

Next, a reciprocating diaphragm pump 41, which is another embodiment of a reciprocating diaphragm pump according to the present invention, will be described.

Figure 3A:
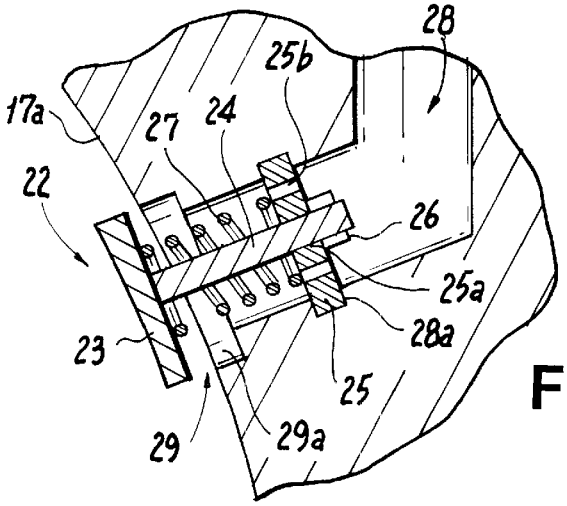
FIG. 3 (*a*) is a vertical cross-section drawing to which reference will be made in describing a diaphragm breakage preventing means mounted in a reciprocating diaphragm pump when a protective plate is in a projected state.
Figure 3B:
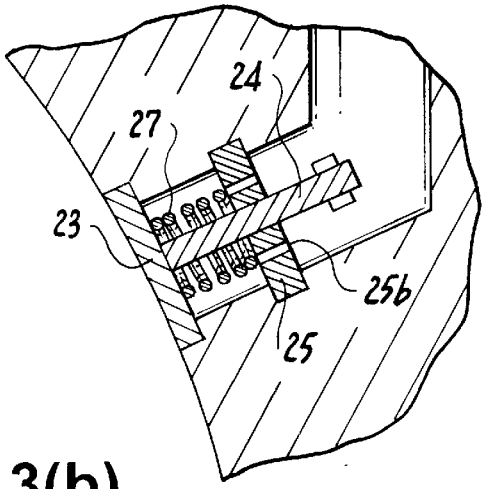

Referring now to FIGS. 3(*a*) and 3(*b*), a reciprocating diaphragm pump 41 includes diaphragm breakage preventing means and a discharge opening section that differ from diaphragm breakage preventing means 8 and the discharge opening section 20 from the reciprocating diaphragm pump 1. Other elements have the same structure as the reciprocating diaphragm pump 1, and their description is omitted herefrom. Thus, only the structures in the reciprocating diaphragm pump 41 for diaphragm breakage preventing means 22, the discharge opening section 29, and the discharge flow path 28 are indicated.

Diaphragm breakage preventing means 22 is equipped with a opening/closing plate that is normally open and that can open and close a pumped fluid discharge using a biasing member. More specifically, diaphragm breakage preventing means 22 includes a protective plate 23, which also serves as the opening/closing plate, a shaft 24, a support plate 25, a stopper 26, and a spring 27, which serves as a biasing member.

The protective plate 23 is a disc-shaped member that is sized to fit snugly in a ring-shaped cavity 29*a* disposed on the discharge opening section 29. In other words, when the protective plate 23 is moved into the ring-shaped cavity 29*a*, there is essentially no space between the protective plate 23 and the inner perimeter surface forming the ring-shaped cavity 29. Also, the end surface of diaphragm breakage preventing means 22 facing the pumped fluid chamber 9*b* essentially never becomes concave or convex relative to the concave surface 17*a*. A shaft 24 is disposed perpendicular to an end surface of the protective plate 23 at the center of the end surface.

A ring-shaped cavity 28*a* is disposed at the inner perimeter surface of the discharge flow path 28. The support plate 25, a disc-shaped member, is mounted in the ring-shaped cavity 28*a*. The support plate 25 is formed with a central opening 25*a* that passes through both end surfaces parallel to the central axis. The opening 25*a* has a diameter that allows the shaft 24 to slide freely therein. A large number of openings 25*b* are formed through the support plate 25 to allow pumped fluid to flow smoothly from the pumped fluid chamber 9*b* to the discharge valve 7.

The shaft 24 passes through the opening 25*a* of the support plate 25. The stopper 26 is disposed at the end of the shaft 24 to limit outward displacement of the protective plate. The stopper 26 is a disc-shaped member with an opening extending to both end surfaces at the center of the end surfaces. The opening allows the shaft 24 to be fitted. With the shaft 24 fitted in the opening, the stopper 26 is fixed to the shaft 24. The shaft 24 is long enough so that when the stopper 26 abuts the support plate 25, the protective plate 23 projects into the pumped fluid chamber 9*b*, and a space is formed between the protective plate 23 and the cavity surface 17*a* to allow smooth flow of the pumped fluid from the pumped fluid chamber 9*b* to the discharge flow path 28.

The spring 27 is mounted between the protective plate 23 and the support plate 25 with the shaft 24 held in the inner space formed by the spiral member. The tension of the spring 27 pushes the protective plate 23 toward the pumped fluid chamber 9*b*. Outward motion of the protective plate 23 is stopped when the stopper 26 abuts the support plate 25. This keeps the protective plate 23 in an open state. The elasticity of the spring 27 is such that, when the reciprocating diaphragm pump 41 is in its discharge stage, the deformation of the diaphragm 4 toward the pumped fluid side pushes the protective plate 23 into the ring-shaped cavity 29*a* against the urging of the spring 27, as shown in FIG. 3 (*b*). At all other times, the protective plate 23 is projected into the pumped fluid chamber 9*b*, as shown in FIG. 3 (*a*).

There are no particular restrictions for the material used for diaphragm breakage preventing means 22 as long as it can provide adequate mechanical strength for the operations of the reciprocating diaphragm pump 41. For example, metallic materials, synthetic resin materials, or the like can be used as appropriate.

Next, the operations of the reciprocating diaphragm pump 41 will be described.

The operations of the piston 5, the diaphragm 4, the working oil, and the like are roughly the same as with the reciprocating diaphragm pump 1.

First, as the piston 5 moves back, the diaphragm 4 is pulled toward the working oil side. When this happens, pumped fluid is sucked in. The pumped fluid pushes up the valve 6*a* of the intake valve 6 and flows through the intake flow path 19 into the pumped fluid chamber 9*b*. Then, when the pressure in the pumped fluid chamber 9*b* returns to its normal pressure, the flow of the pumped fluid into the pumped fluid chamber 9*b* is stopped, the valve 6*a* returns to its lowermost point, and the intake flow path of the pumped fluid is sealed.

After reaching its rearward endpoint, the piston 5 moves forward. This causes the diaphragm 4 to be pushed to the pumped fluid side. When this happens, the pumped fluid in the pumped fluid chamber 9*b* cannot move toward the intake flow path 21 since, as described above, the intake valve 6 is sealed. In this state, the protective plate 23 of diaphragm breakage preventing means 22 is projected toward the pumped fluid chamber 9*b* by the tension from the spring 27, as shown in FIG. 3 (*a*). A space is formed between the protective plate 23 and the concave surface 17*a* to allow the pumped fluid to flow in. Also, since openings are formed on the support plate 25 to allow smooth movement of the pumped fluid, the pumped fluid in the pumped fluid chamber 9*b* passes through the gap between the protective plate 23 and the concave surface 17 as well as the openings formed on the support plate 25 and moves into the discharge flow path 28, where it pushes up the valve 7*a* of the discharge valve 7 and is discharged out from the pump.

As the piston 5 moves forward, the diaphragm 4 is deformed toward the pumped fluid side until it abuts the end surface of the protective plate 23 toward the pumped fluid chamber 9*b*. The diaphragm 4 then pushes the protective plate in the direction of the discharge flow path 28 in opposition to the tension from the spring 27. Finally, the support plate 25 is pushed into the ring-shaped cavity 29*a*. This closes off the discharge flow path 28, but the diaphragm 4 pushes the support plate 25 into the ring-shaped cavity 29*a* while pushing out the pumped fluid between the diaphragm 4 and the cavity surface 17*a*, there is essentially no pumped fluid remaining between the diaphragm 4 and the cavity surface 17*a* even if the discharge flow path 28 is sealed. Thus, the pumped fluid is discharged effectively.

Furthermore, when the protective plate 23 is pushed into the ring-shaped cavity 29*a*, there is essentially be no space into which the diaphragm can be pushed when the diaphragm 4 is pushed by the pressure from the working oil. Thus, with the reciprocating diaphragm pump 41 equipped with diaphragm breakage preventing means 22, deformation, breakage, or the like in the diaphragm 4 will not take place even if the diaphragm 4 is pushed harder than usual against the cavity surface 17*a* due to there being, for example, more than a predetermined amount of working oil in the pump chamber 9 or the like.

When the protective plate 23 is held in the ring-shaped cavity 29*a* and the discharge flow path 28 is sealed, the discharge valve 7 returns to its lowermost point. After reaching its forward endpoint, the piston 5 moves backwards. As this happens, the diaphragm 4 is deformed toward the working oil side, and the tension from the spring 27 urges the protective plate 23 to project into the pumped fluid chamber 9*b* again. The pumped fluid pushes up the suction valve 6 to permit pumped fluid to flow into the pumped fluid chamber 9*b*.

The reciprocating diaphragm pump 41 repeats these steps and provides fluid transfer while preventing deformation, breakage, and the like of the diaphragm.

The reciprocating diaphragm pump according to the present invention includes diaphragm breakage preventing means. This makes it possible to prevent deformation, breakage, and the like of the diaphragm caused by the diaphragm being pushed into the discharge opening, a problem that occurs with conventional reciprocating diaphragm pumps that do not include a counter plate on the pumped fluid side. Also, when transferring slurry, it is possible to prevent the reduction of transfer performance due to sedimentation of solids between the counter plate on the pumped fluid side and the diaphragm.

The deformation, breakage, and the like tends to occur especially if there is too much working oil when the reciprocating diaphragm pump is started up. Thus, in conventional reciprocating diaphragm pumps, the operating procedures must be maintained very strictly. However, with the reciprocating diaphragm pump according to the present invention, deformation, breakage, or the like will not take place even if there is some excess working oil. Thus, extra time does not need to be expended to keep to operating procedures strictly, and work time can be reduced.

The reciprocating diaphragm pump according to the present invention can be produced simply by installing diaphragm breakage preventing means to the discharge opening of a conventional reciprocating diaphragm pump. Thus, there is no need to make major changes to the conventional reciprocating diaphragm pump, allowing production at low costs.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A reciprocating diaphragm pump comprising:

a pump chamber;

a diaphragm dividing said pump chamber into an active oil chamber and a pumped fluid chamber;

a pumped fluid intake opening section for admitting pumped fluid to said pumped fluid chamber;

a pumped fluid discharge opening section for discharging said pumped fluid from said pumped fluid chamber; and said pumped fluid discharge opening section includes means for preventing diaphragm breakage when said pumped fluid in said pumped fluid chamber is discharged from said pumped fluid chamber.

2. A reciprocating diaphragm pump as described in claim 1 wherein:

said diaphragm breakage preventing means is a body at least one opening therein;

said diaphragm breakage preventing means is mounted at a fluid exit from said pumped fluid chamber, whereby said diaphragm contacts a surface of said diaphragm breakage preventing means at an extreme of motion of said diaphragm; and a size of said at least one opening being small enough to prevent substantial deformation of said diaphragm therethrough and being large enough to permit sufficient flow of pumped fluid therethrough.

3. A reciprocating diaphragm pump according to claim 2, wherein said at least one opening includes a plurality of openings.

4. A reciprocating diaphragm pump comprising:

a pump chamber;

a diaphragm dividing said pump chamber into an active oil chamber and a pumped fluid chamber;

a pumped fluid intake opening section for admitting pumped fluid to said pumped fluid chamber;

a pumped fluid discharge opening section for discharging said pumped fluid from said pumped fluid chamber;

said pumped fluid discharge opening section includes means for preventing diaphragm breakage when said pumped fluid in said pumped fluid chamber is discharged from said pumped fluid chamber;

said diaphragm breakage preventing means being a body at least one opening therein;

which body is mounted at a fluid exit from said pumped fluid chamber, whereby said diaphragm contacts a surface of said diaphragm breakage preventing means at an extreme of motion of said diaphragm; the size of said at least one opening being small enough to prevent substantial deformation of said diaphragm therethrough and being large enough to permit sufficient flow of pumped fluid therethrough; and said body being a disk shaped body mounted in a ring-shaped cavity disposed at said pumped fluid discharge opening.

5. A reciprocating diaphragm pump comprising:

a pump chamber;

a diaphragm dividing said pump chamber into an active oil chamber and a pumped fluid chamber;

a pumped fluid intake opening section for admitting pumped fluid to said pumped fluid chamber;

a pumped fluid discharge opening section for discharging said pumped fluid from said pumped fluid chamber; and said pumped fluid discharge opening section includes means for preventing diaphragm breakage when said pumped fluid in said pumped fluid chamber is discharged from said pumped fluid chamber;

said diaphragm breakage preventing means including:

a movable plate;

resilient means for maintaining said movable plate in a normally open position; and means for permitting said movable plate to move into a closed position covering said fluid exit when said diaphragm is at its extreme discharge position.

* * * * *